US006785922B2

(12) United States Patent
Bretschger et al.

(10) Patent No.: US 6,785,922 B2
(45) Date of Patent: Sep. 7, 2004

(54) MATTRESS WITH INTERNAL VIBRATOR

(75) Inventors: Edward B. Bretschger, Hinsdale, IL (US); Peter J. Myers, Wheaton, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

(21) Appl. No.: 10/033,679

(22) Filed: Dec. 27, 2001

(65) Prior Publication Data

US 2003/0121104 A1 Jul. 3, 2003

(51) Int. Cl.[7] ..... A47C 17/00

(52) U.S. Cl. ..... 5/694; 5/690; 5/915; 601/57; 601/70

(58) Field of Search ..... 5/694, 915; 601/56–60, 601/70, 71, 79, 83, 48

(56) References Cited

U.S. PATENT DOCUMENTS

| | | | | |
|---|---|---|---|---|
| 937,825 | A | 10/1909 | Lend | |
| 1,110,920 | A | 9/1914 | Gibson et al. | |
| 2,425,655 | A | 8/1947 | Tompkins | 128/33 |
| 2,478,445 | A | 8/1949 | Yurkovich | 5/109 |
| 2,580,598 | A | 1/1952 | Rody | 161/22 |
| 2,668,302 | A | 2/1954 | Dengrove | 5/104 |
| 2,852,021 | A | 9/1958 | Jessup | 128/33 |
| 2,910,977 | A | 11/1959 | Jeter | 128/33 |
| 3,048,168 | A | 8/1962 | Kamp | 128/33 |
| 3,092,100 | A | 6/1963 | Oetinger | 126/33 |
| 3,194,522 | A | 7/1965 | Azneer | 248/18 |
| 3,311,935 | A | 4/1967 | Petty | 5/109 |
| 3,732,860 | A | 5/1973 | Thurner | 128/33 |
| 3,854,474 | A | 12/1974 | Carruth | 128/33 |
| 3,872,526 | A | 3/1975 | Betts | 5/348 WB |
| 3,882,556 | A | 5/1975 | Accurso | 5/109 |
| 3,885,553 | A | 5/1975 | Vecchio | 128/24.1 |
| 3,934,283 | A | 1/1976 | Raffel | 5/109 |
| 3,955,222 | A | 5/1976 | Pater | 5/109 |
| 4,066,072 | A | 1/1978 | Cummins | 128/40 |
| 4,114,215 | A | 9/1978 | Santo | 5/370 |
| 4,157,088 | A | 6/1979 | Gracey | 128/33 |
| 4,326,506 | A | 4/1982 | Kawabata | 128/33 |
| 4,328,598 | A | 5/1982 | Evanson | 5/401 |
| 4,370,602 | A | 1/1983 | Jones, Jr. et al. | 318/114 |
| 4,371,815 | A | 2/1983 | Jones, Jr. et al. | 318/114 |
| 4,544,867 | A | 10/1985 | Jones, Jr. et al. | 318/129 |
| 4,559,929 | A | 12/1985 | Hseu | 128/33 |
| 4,667,358 | A | 5/1987 | Penterman | 5/508 |
| 4,681,096 | A | 7/1987 | Cuervo | 128/33 |
| 4,752,980 | A | 6/1988 | Nafte | 5/109 |
| 4,872,229 | A | 10/1989 | Brady | 5/455 |
| 4,893,366 | A | 1/1990 | Rosóén | 5/109 |
| 5,003,651 | A | 4/1991 | Rosóén | 5/109 |
| 5,007,410 | A | 4/1991 | DeLaney | 128/33 |
| 5,081,722 | A | 1/1992 | Yu | 5/99.1 |
| 5,140,977 | A | 8/1992 | Raffel | 128/36 |
| 5,183,457 | A | 2/1993 | Gatts et al. | 600/21 |
| 5,235,258 | A | 8/1993 | Schuerch | 318/16 |
| 5,361,437 | A | 11/1994 | Zhu et al. | 5/639 |
| 5,437,607 | A | 8/1995 | Taylor | 601/49 |

(List continued on next page.)

*Primary Examiner*—Teri Pham Luu
(74) *Attorney, Agent, or Firm*—Marshall, Gerstein & Borun LLP

(57) ABSTRACT

A mattress has an internal support structure and an external cladding that surrounds and covers at least a portion of the support structure. The mattress also has a vibrating device that is coupled to a part of the support structure. The vibrating device has a motor that operates to transmit vibrations throughout the support structure when turned on. The mattress can be adapted to gradually slow at a controlled rate to a complete stop over a period of time when turned off. The mattress can also be adapted to include the vibrating device internally where the device is water resistant. The mattress can also be adapted such that the vibrating device can be easily removed and installed from a pocket provided in the mattress.

18 Claims, 6 Drawing Sheets

U.S. PATENT DOCUMENTS

| | | | | | |
|---|---|---|---|---|---|
| 5,437,608 | A | | 8/1995 | Cutler | 601/49 |
| 5,442,710 | A | | 8/1995 | Komatsu | 381/24 |
| 5,509,154 | A | | 4/1996 | Shafer et al. | 5/453 |
| 5,542,138 | A | | 8/1996 | Williams | 5/658 |
| 5,544,376 | A | | 8/1996 | Fromson | 5/618 |
| 5,600,214 | A | | 2/1997 | Fromson | 318/120 |
| 5,606,754 | A | | 3/1997 | Hand et al. | 5/713 |
| 5,611,771 | A | * | 3/1997 | Taylor | 601/70 |
| 5,624,155 | A | | 4/1997 | Bluen et al. | 297/217.3 |
| 5,652,484 | A | | 7/1997 | Shafer et al. | 318/16 |
| 5,771,511 | A | | 6/1998 | Kummer et al. | 5/600 |
| 5,787,528 | A | | 8/1998 | Antinori | 5/616 |
| 5,797,860 | A | | 8/1998 | Moriyasu | 601/30 |
| 5,807,287 | A | | 9/1998 | Cheng | 601/60 |
| 5,836,900 | A | | 11/1998 | Leventhal | 601/57 |
| 5,845,350 | A | | 12/1998 | Beemiller et al. | 5/109 |
| 5,853,005 | A | | 12/1998 | Scanlon | 128/662.03 |
| 5,857,985 | A | | 1/1999 | Feng | 601/47 |
| 5,865,771 | A | | 2/1999 | Shuto et al. | 601/47 |
| 5,951,500 | A | | 9/1999 | Cutler | 601/47 |
| 5,953,773 | A | | 9/1999 | Asada et al. | 5/81.1 R |
| 5,969,488 | A | | 10/1999 | Fromson | 318/16 |
| 6,008,598 | A | | 12/1999 | Luff et al. | 318/16 |

* cited by examiner

MATTRESS WITH INTERNAL VIBRATOR

FIELD OF THE INVENTION

The invention is generally related to mattresses, and more particularly to a mattress having an internal vibrator and to a method of slowing and stopping a mattress vibrator.

BACKGROUND OF THE INVENTION

Mattresses that have internal vibrators are known. The internal vibrator of such a mattress produces vibrations that can be felt when touching the mattress surfaces. A typical mattress has a skeletal support structure in the form of springs and interconnecting members or links and one or more cladding layers surrounding most or all of the structure. A typical vibrating mattress has a vibrating motor mounted within the mattress and attached to one or more of the springs and/or one or more of the interconnecting members. Vibration of the motor is transmitted to the skeleton structure and then transmitted throughout the skeleton structure.

A typical vibrating device for a mattress turns on and off rather suddenly. The vibrations are immediately transmitted when the device is turned on and immediately stopped when turned off. One problem with such a mattress is that the sudden elimination of vibration can be quite noticeable to an individual that is supported on the mattress. In particular, abrupt elimination of mattress vibration in a child's mattress can disturb or arouse a child sleeping on the mattress. All or most benefits gained by using the vibrating mattress are therefore lost when the child is suddenly awakened upon abrupt shut off the vibrating motor.

Another problem with such mattresses is that the vibrating motor and mechanisms are not protected from contact with liquids. The internal components of an internal vibrating device may be fairly well protected from physical damage when mounted inside a mattress. However, mattresses are typically not constructed as waterproof. A liquid spill on the mattress can seep into the mattress interior and cause damage to the vibrating device and/or components. This can be of particular concern for a child's mattress, because children are susceptible to bed wetting.

A further problem with vibrating mattresses of this type is that it can be difficult to repair or replace the vibrating device and/or its components. Failure of one or more components will require service or replacement. Instead of repairing or replacing the vibrating device, the mattress may simply be discarded prematurely or used without the vibrating feature. In order to access the internal vibrating motor and/or components, the mattress cladding must be removed, damaged, or destroyed. It can be quite costly and time consuming to repair or replace an internal vibrator because of the resultant damage to the mattress. Therefore, once a component fails, the necessary repairs may not be undertaken.

BRIEF DESCRIPTION OF THE DRAWINGS

Exemplary vibrating mattress constructions and methods in accordance with the teachings of the present invention are described and explained in greater detail below with the aid of the drawing figures in which.

DETAILED DESCRIPTION OF THE PREFERRED EMBODIMENTS

One example of a vibrating mattress and a method is disclosed herein according to the teachings of the present invention. The disclosed vibrating mattress generally has an internal vibrating mechanism that can incorporate a number of features. The internal vibrator does not suddenly turn off from an operating condition, but instead can gradually slow to a stop over a predetermined period of time. This prevents abrupt change from a vibrating condition to a non-vibrating condition, and thus reduces or eliminates the likelihood of disrupting or awakening someone on the mattress when the vibrating device turns off. In addition, the disclosed mattress can also include a vibrating device that can be easily removed, repaired, and/or replaced without causing damage to the mattress, without requiring significant time and expense, and without causing an interruption in use of the mattress. Further, the disclosed mattress can have an internal vibrator that is waterproof and thus protected from damage by contact with fluids. Thus, the vibrating device is not susceptible to damage if fluid is spilled on the mattress or if a child wets on the mattress.

Figure 1:
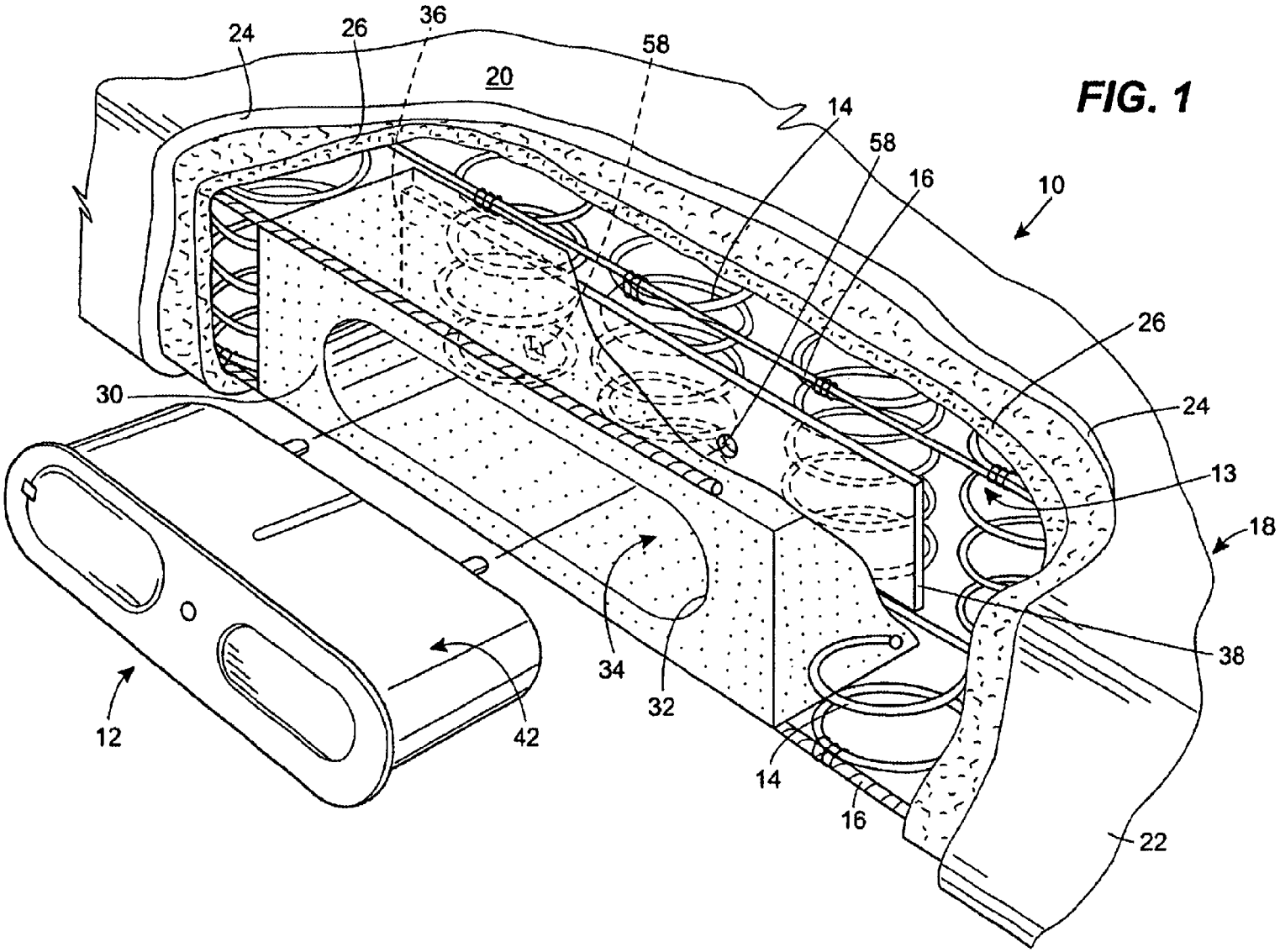
FIG. 1 is a partial cut-away and exploded perspective view of one example of a mattress and internal vibrator constructed according to the teachings of the present invention.

Referring now to the drawings, FIG. 1 is a partial cut-away and exploded perspective view of one example of a mattress and internal vibrator constructed according to the teachings of the present invention. A mattress 10 is shown with a vibrating device 12 removed from the mattress. The mattress 10 generally has an internal skeleton or support structure 13 including a plurality of springs 14 and interconnecting links 16. Together, the links 16 and springs 14 create the interconnected lattice support structure 13 for the mattress 10 as is generally known to those of ordinary skill in the art. Alternatively, the mattress 10 can include other types of internal support structures 13 such as solid or layered foam materials, other mechanical support constructions, or the like. The internal vibrator and its features are equally suited for many different types and constructions of mattresses, including a solid block of foam.

In the disclosed example, the mattress 10 also has an exterior cladding 18 that covers and defines at least one resting surface 20 and a plurality of side surfaces 22 of the mattress. The mattress 10 typically has a three-dimensional rectangular configuration including the top resting surface 20, a bottom surface (not shown herein), and four side surfaces 22 as is known to those of ordinary skill in the art. The cladding 18 often covers the entire supporting structure of a mattress on all sides. However, certain types of mattresses, such as box springs, may have cladding only on the top resting surface 20 and, more than likely, the side surfaces 22. However, box springs are not typically used to define an upper surface on which individuals rest, but instead are intended to support a mattress thereon. The vibrating device 12 of the present invention can alternatively be mounted to a box spring for transmitting vibrations to an upper mattress resting on the box spring.

In the disclosed example, the cladding 18 includes a top or outer layer 24 of a sheathing material. The outer layer may or may not include padding. The mattress also has at least one inner padding layer 26 of a different material. The outer layer 24, whether padded or not, typically provides an aesthetic appearance that is desired for the mattress. The inner layer 26 typically provides padding so that the individual springs 14 and links 16 are not detectable by an individual on the top resting surface 20. When the cladding 18 entirely encompasses the support structure 13 of the mattress 10, the mattress can typically be inverted so that either the top or bottom surface is exposed as the resting surface 20. With such a mattress construction, the inner layer 26 and outer layer 24 preferably mask the existence of the springs 14 and links 16 of the support structure 13 regardless of which side of the mattress is exposed for use.

The disclosed vibrating device 12 as illustrated in FIG. 1 is received in a pocket 30 provided in one of the side surfaces 22 of the mattress 10. The pocket 30 generally has an opening 32 that exposes the pocket interior to the exterior of the mattress. The vibrating device 12 is received through the opening 32 into the pocket 30. The pocket 30 terminates at a bottom surface 36. In one example, the bottom surface 36 bears against or otherwise contacts a vibration transmission plate 38. In another example, the bottom surface 36 of the pocket 30 is the transmission plate 38. The transmission plate 38 is mechanically connected to one or more of the springs 14 and/or the links 16. The transmission plate 38 can bear against and directly contact one or more of the support structure elements 14 or 16, or can be physically attached to one or more of these elements.

The pocket 30 as illustrated in the example of FIG. 1 is provided in a solid block of material, such as a foam, that is mounted within a portion of the mattress. The layers 24 and 26 of the cladding 18 are shown cut-away, but preferably cover a majority of the block of material for aesthetic appearance, and yet expose the opening 32 and the interior of the pocket 30. In this example, the pocket material can be a semi-rigid foam and the pocket 30 can be sized to closely contact the vibrating device 12 as described below to retain the vibrating device in the pocket 30, absorb relatively little vibration, and yet permitting the vibrating device to be easily removed.

Figure 2:
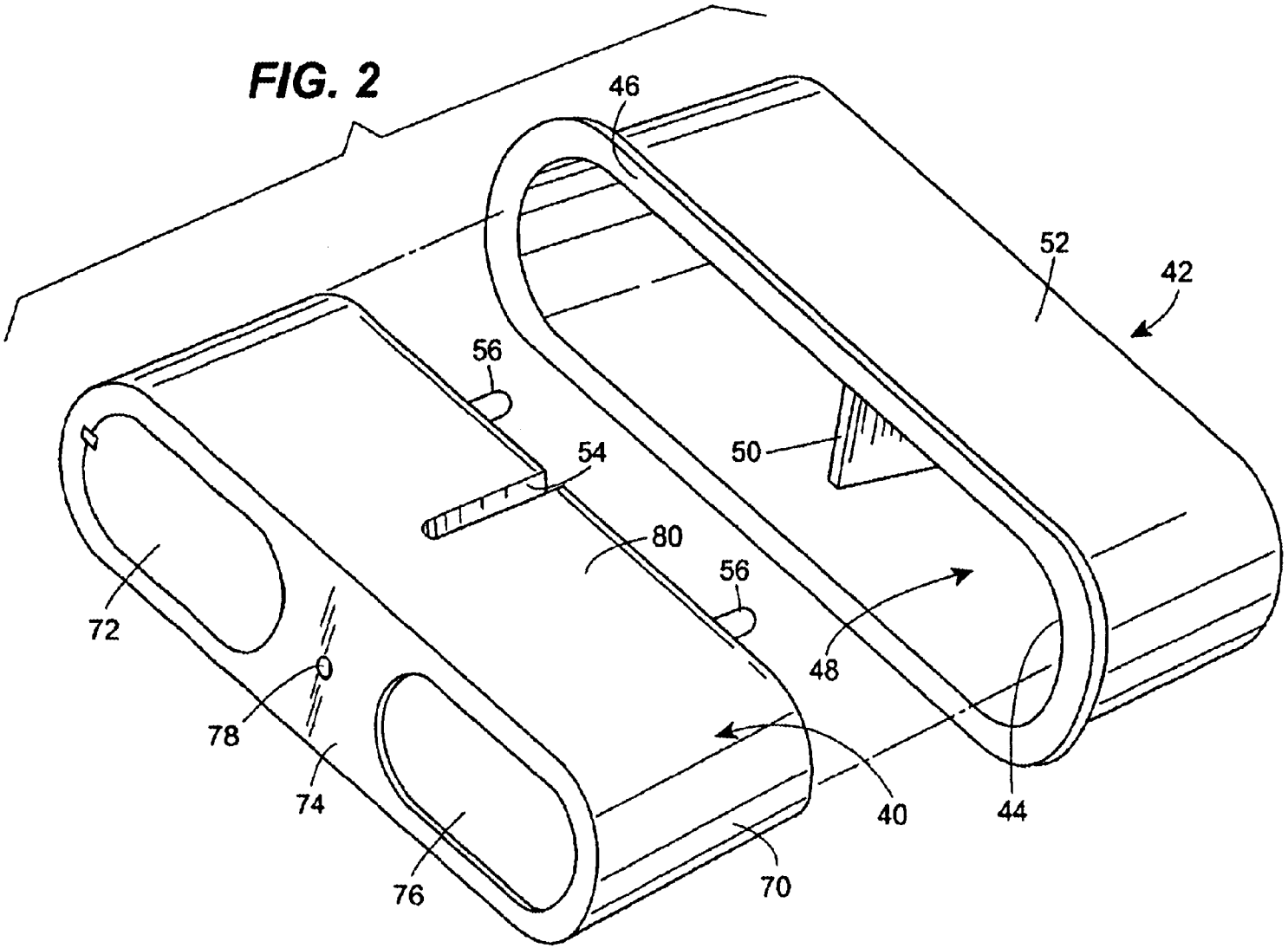
FIG. 2 is an exploded view of the internal vibrator shown in FIG. 1, and illustrating the motor housing and exterior sleeve.

As shown in FIG. 2, the vibrating device 12 has a motor housing 40 containing various vibration components therein. The device 12 also has a sleeve 42 in which the assembled motor housing 40 is received. The sleeve 42 can be used in conjunction with the pocket 30, as is disclosed herein. Alternatively, the sleeve can replace the pocket 30 and be installed within the mattress 10 for receiving the assembled motor housing 40. As another alternative, the motor housing 40 can include the disclosed features of the sleeve 42. The sleeve 42 can then be eliminated and the assembled motor housing 40 can be mounted directly in the pocket 30.

In this disclosed example, the sleeve 42 has an opening 44 in its front face 46. The sleeve also has an interior 48 for receiving the assembled motor housing 40 within the sleeve. In this example, the sleeve 42 includes a bridge 50 spanning between two side walls 52 of the sleeve. The bridge 50 adds structural rigidity and support between the side walls 2 when the motor housing is removed from the sleeve. The motor housing 40 of the vibrating device 12 has a corresponding slot 54 that receives the bridge 50 therein when the assembled motor housing is installed in the sleeve.

Friction between the slot and bridge can be utilized to retain the vibrating device 12 in the sleeve when installed and also to assist in transmitting vibration 30 from the motor housing 40 to the sleeve 80. A detent mechanism can also be formed on the slot and bridge to provide some positive retention between the sleeve 42 and the motor housing 40 when assembled. The sleeve can be molded or formed as a one-piece unitary structure from any suitable material such as plastic, metal, or the like. The sleeve can also be a two-piece clam shell construction, similar to the motor housing, as described below In one example as illustrated in FIG. 1, the vibrating device 12 can be pre-assembled to include both the sleeve 42 and the assembled motor housing 40. As illustrated in FIG. 1, the fully assembled vibrating device 12 is then installed in the pocket 30 of the mattress 10. Alternatively, the sleeve 42 can be pre-mounted separately within the pocket 30, and then the assembled motor housing 40 can be installed in the pocket 30 and sleeve 42.

As shown in FIGS. 1 and 2, the vibrating device 12 in the present disclosed example has a pair of protrusions 56 extending outward from a bottom end 57 of the motor housing 40. When the vibrating device 12 is received in the pocket 30, the protrusions 56 are received in corresponding bores or holes 58 provided in the bottom of the pocket 30 and/or in the transmission plate 38, depending upon the pocket bottom construction as noted above. Vibration from the device 12 is transmitted from the device through the protrusions 56 and into the transmission plate 38. The protrusions 56 and bores 58 can also assist in guiding the vibrating device 12 into position within the pocket 30 and can be designed to assist in retaining the vibrating device as installed in the mattress, if desired.

As is evident from a review of FIGS. 1 and 2, the protrusions 56 can extend from a bottom surface 60 of the sleeve 42 (not shown) or from the bottom end 57 of the motor housing 40 (as shown). If provided on the sleeve, the motor housing need not include protrusions. If provided on the motor housing as shown, the sleeve, if present, can have suitable openings 62 for permitting the protrusions 56 to pass through the sleeve bottom and into the bores 58.

Figure 3:
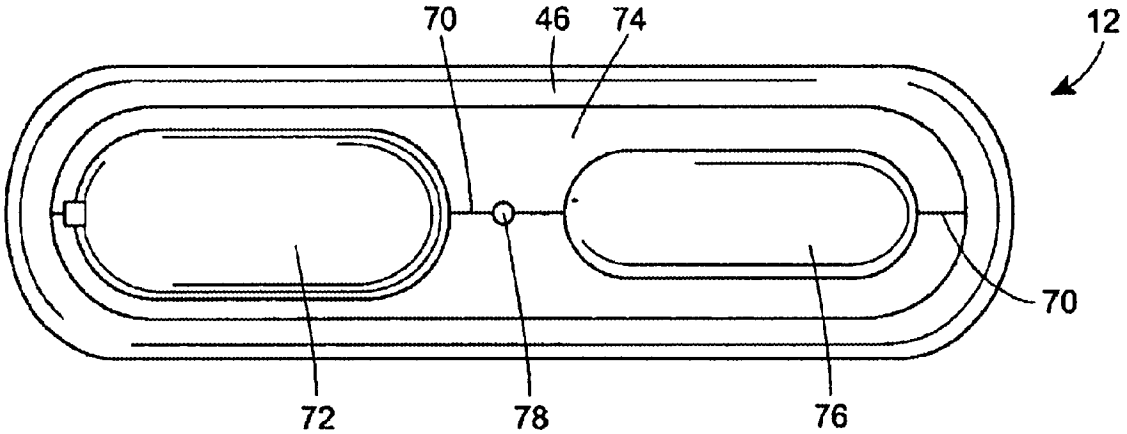
FIG. 3 is a front view of the internal vibrator shown in FIG. 1.
Figure 4:
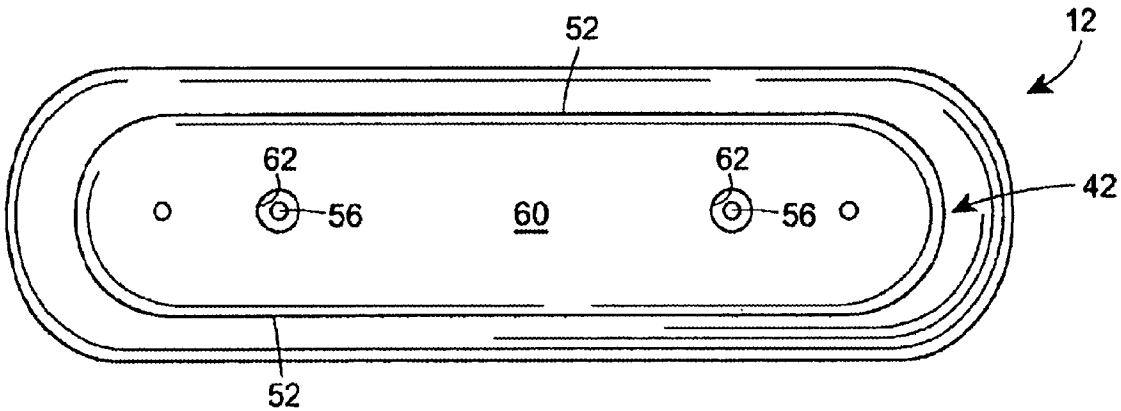
FIG. 4 is a back view of the internal vibrator shown in FIG. 1.
Figure 5:
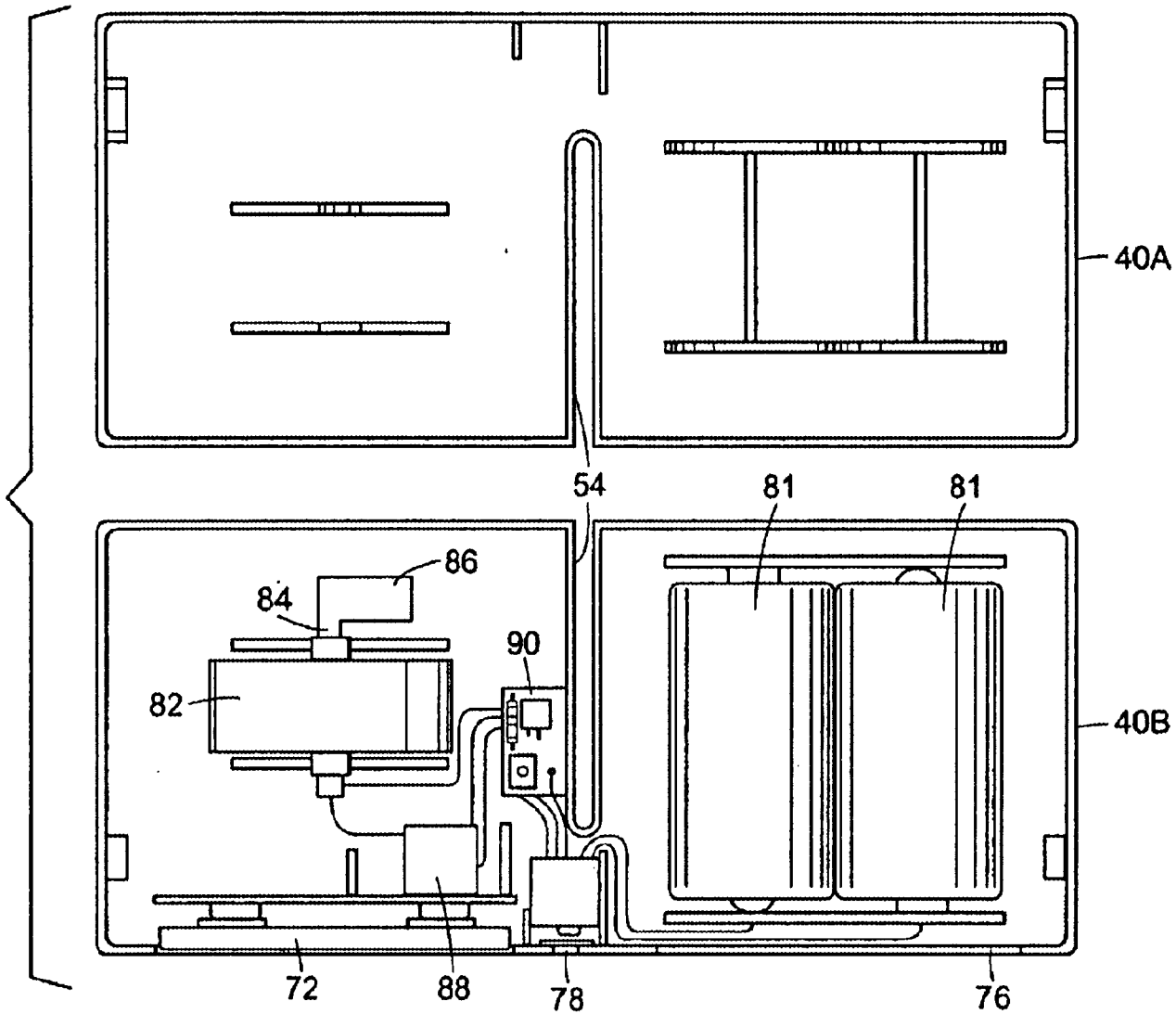
FIG. 5 is a plan view of the internal vibrator motor housing separated into two sections and folded open showing the internal components.

FIGS. 3 and 4 illustrate a front view and back view, respectively, of the vibrating device 12. FIG. 5 illustrates various internal components of the vibrating device 12 and shows the motor housing 40 split in two and folded open. In general, the disclosed motor housing 40 is provided in two sections 40A and 40B. The motor housing 40 can be made of metal, plastic, or any other suitable material. The two motor housing sections 40A and 40B can be screwed, snapped, welded, bonded, or otherwise suitably fastened together. A seam or parting line 70 of the two assembled sections 40A and 40B, if fastened together, is preferably sealed. The intent of the motor housing 40 is to encase the internal components of the vibrating device within a hard protective shell that is also a water resistant or waterproof environment. If the motor housing 40 is not itself at least water resistant, the vibrating device 12 is preferably rendered waterproof when the motor housing 40 is installed in the sleeve 42.

The vibrating device 12 has at least one exposed power button 72 exposed on a front face 74 for selectively operating parameters of the device. For example, the button 72 can be for turning the vibrating device on and off and for changing speeds of the device. In this disclosed example, a battery cover 76 is also exposed on the front face 74. As will be evident to those of ordinary skill in the art, the front face 74 and the variety of exposed elements and controls can vary considerably and yet fall within the scope of the present invention. For example, a display (not shown) can be provided indicating various operating perimeters of the device if so desired. These can include the desired run time, the elapsed time, the vibration frequency and/or amplitude, battery life, and the like. In the present example, a light emitting diode (LED) 78 is also provided on the front face 74. The LED 78 can be illuminated when the device 12 is turned on by the button 72 and can be extinguished when the device is turned off.

The motor housing 40 has an exterior wall 80 that extends between the front and rear faces 74 and 57, respectively. The exterior wall 80 in the disclosed example is defined by the two motor housing sections 40A and 40B when the motor housing is assembled. The motor housing wall 80 and the front and rear faces 74 and 57 completely enclose the vibrating device components within the motor housing. The exterior wall 80 has a contour that substantially matches the shape of the sleeve interior 48. The motor housing 40 of the vibrating device 12 preferably has a slight interference fit within sleeve interior 48. Similarly, the sleeve side walls 52 have a contour that essentially matches the shape of the pocket 30 and have a relatively tight fit within the pocket. This will ensure that when the vibrating device is fully installed in the mattress, the device does not move and is closely held within the pocket. This further ensures that substantially all of the vibrations created by the device 12 are transmitted to the transmission plate 38 and not absorbed by the sleeve and/or pocket.

FIG. 5 illustrates one of many possible examples of the internal components of the vibrating device 12. For example, the disclosed device 12 has a power source 81 such as a battery that selectively powers a motor 82. The battery is received in a battery receptacle within the housing 40 that is accessible through the battery cover 76. The motor 82 drives a rotary shaft 84 which carries a weight 86 with a center of gravity that is offset or out of balance relative to a shaft rotation axis. By rotating the shaft and weight, the eccentricity or out-of-balance causes the entire vibrating device 12 to vibrate. The mass of the weight 86, the amount of offset relative to the rotation axis, and the rotational speed of the motor 82 determine the vibration rate or frequency and the vibration amplitude of the device. The frequency, amplitude, or both can be controlled by component design and by changing motor operation parameters determined as desired. The internal components can also include a switch 88 connected to the button 72. The switch can be coupled to electronic circuitry that includes a microprocessor 90 to control one or more perimeters of the device. The microprocessor 90 and electronic circuitry can also be connected to the LED 78 to controllably actuate the LED.

The circuitry and microprocessor 90 can be initially designed and programed to operate the motor 82 at one or more than one different rotational speeds. The speeds can be selectively controlled, if desired, by providing various controls on the front face 74 of the motor housing 40. The microprocessor can alternatively be configured as a programmable processor that a user can selectively program and control operating parameters of the device. The speeds can alternatively be designed to be controlled by the number of times the button 72 and switch 88 are activated. Alternatively, the device can be simply provided with a single speed motor.

The battery access cover 76 and the button 72 can be provided with perimeter seals to inhibit liquid from penetrating the interior of the motor housing 40. Therefore, the assembled vibrating device 12 is at least water resistant of even waterproof. The device can come in contact with liquid when installed in the mattress and remain unharmed.

In the disclosed example, the motor housing 40 of the device is designed to be removed from the sleeve 42, if necessary. In one example, the motor housing 40 is held in place within the sleeve by one or more screws located within the bottom or back of the battery compartment. The entire device 12 can be replaced if it fails, or the device can be removed, repaired, and replaced as needed. As disclosed herein, the battery access cover 76 can be removed from the device front face 74 without removing the entire vibrating device from the mattress so that the battery or power source 81 can then be exchanged easily.

In one disclosed example, the microprocessor 90 and electronic circuitry can be designed or programmed to gradually slow the vibrations of the device from an operating level to a complete stop. Depending upon the construction of the motor, shaft, weight, and/or the processor, either the vibration amplitude or the vibration frequency can be gradually changed from a particular operating level to zero amplitude or zero frequency over a predetermined period of time. This time period can vary considerably and yet fall within the scope of the present invention. However, the time period must be lengthy enough that vibrations created by the vibrating device 12 are not abruptly or suddenly stopped as detected by an individual resting on the mattress 10. In one example, the vibrating device 12 can be gradually slowed to a complete stop from an operating level over about 1 minute. In another example, the time period can be at least about 10 seconds.

The mattress with internal vibrator as disclosed herein produces a number of advantages over prior known vibrating mattresses. First, the vibrations of the mattress are gradually stopped over a period of time. The gradual vibration reduction reduces or eliminates the possibility that an individual resting on the mattress will be suddenly awakened or startled by the abrupt termination of the mattress vibrations. In one example, the motor 82 of the device can be provided as operable at a number of different speeds. The gradual reduction in vibration can be stepped from the highest operating level through the varied intermediate operating levels until reaching a turned off mode (see FIG. 6A). This step reduction can be conducted over the predetermined period of time. Alternatively, the electronic components can be designed or configured to gradually slow at a continuous, or a non-continuous but non-stepped rate (see FIG. 6B).

Figure 6A:
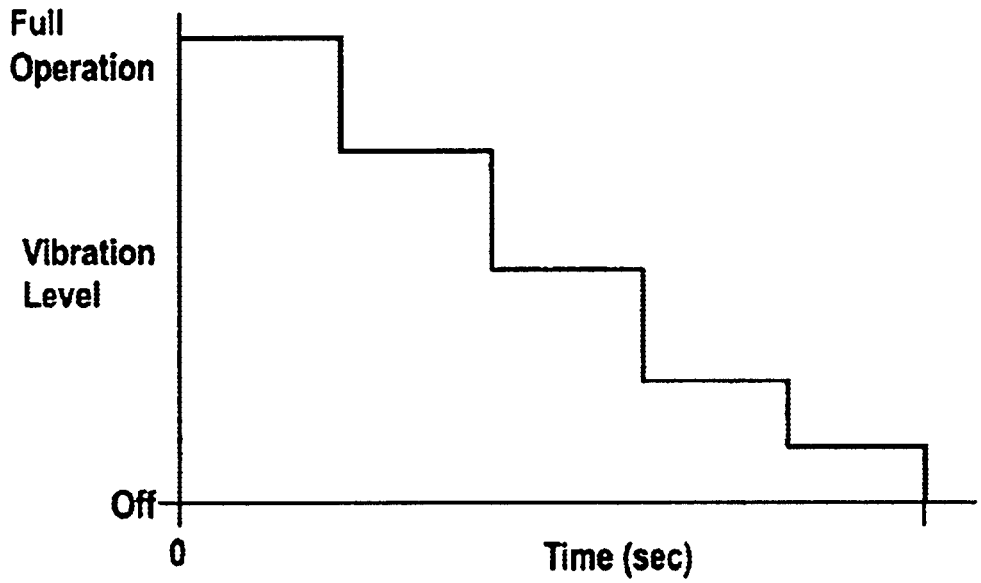
FIGS. 6A and 6B are graphic illustrations of two exemplary methods according to the teachings of the present invention for gradually stopping a motor of a m a t tress vibrating device.
Figure 6B:
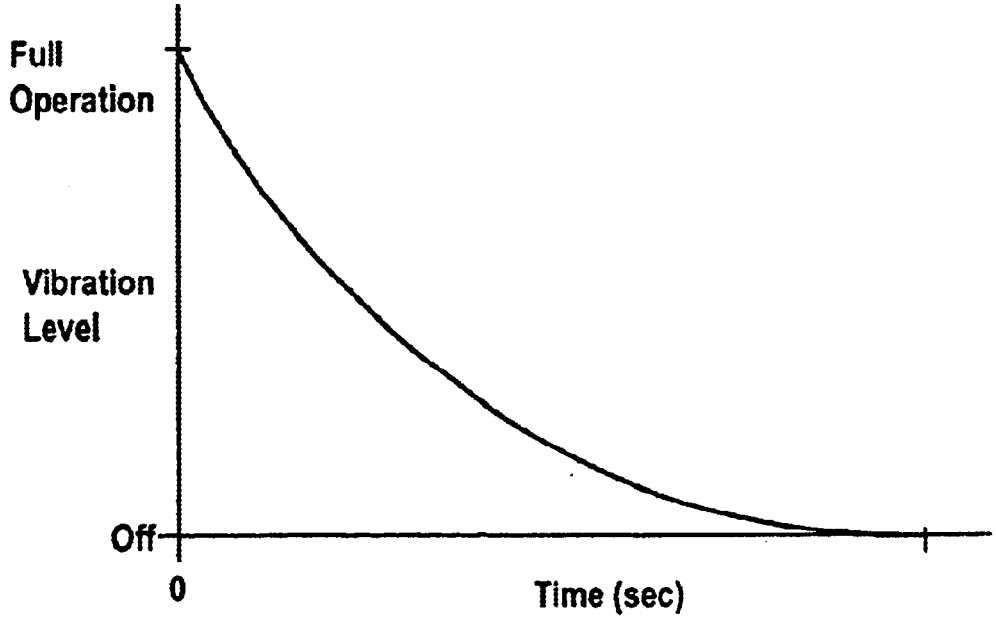
Figure 7:
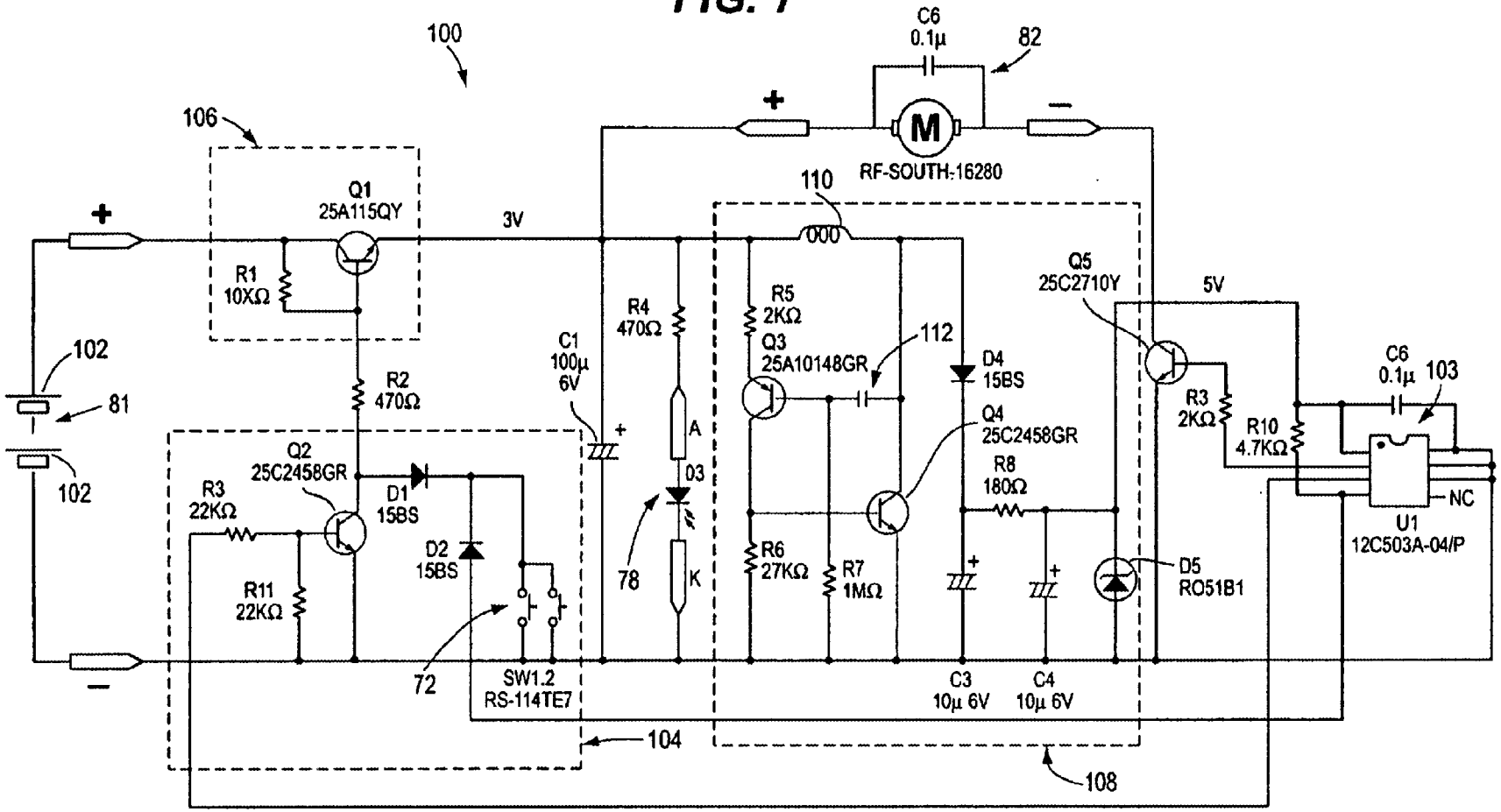
FIG. 7 is a schematic illustration of one example of a motor electronic circuit with an automatic gradual slow down feature useful for the methods shown in FIGS. 6A and 6B.

FIG. 7 illustrates one of many possible examples in schematic form of an electronic circuit 100 for the device 12 wherein the motor speed can be gradually and incrementally stepped down in accordance with the charts shown in FIGS. 6A and 6B. The schematic shows the motor 82 electrically coupled to a power source 81 such as a pair of D-cell batteries 102. The disclosed circuit 100 can vary considerably and yet fall within the scope of the invention. The circuit can be simplified from the schematic that is shown in FIG. 7 and described briefly below. Alternatively, the circuit 100 can be more complex to include additional features if so desired.

The disclosed circuit 100 also includes a timer 103, such as in this example, a 555 electronic timer. The timer 103 can also be in the form of a programmable integrated circuit speed controller or can be incorporated into a microprocessor, such as the processor 90 described generally above. The timer 103 can be a standard chip that is programmed by the manufacturer of the device 12 to operate the vibrating device according to preselected parameters or can be a more complex, user programmable processor.

A switch circuit 104 is coupled to a constant current generator circuit 106 that keeps the circuit 100 linear. The button 72 of the device 12 can be electrically coupled to the switch circuit 104 for activating or deactivating the device. In this example, the batteries 102 produce the supply voltage necessary to operate the circuit 100 and motor 82 when the switch circuit 104 is closed. The supply voltage is also applied across the LED 78 to illuminate the LED indicating that the motor is in the operating mode.

The circuit 100 also has a taper-off circuit 108 that controls a field winding or coil 110 of the motor 82 to thus control and to gradually reduce the motor operational speed. The disclosed electronic timer, in this example, can be selected or set to count down a specific period of motor operation time, such as for example, the last 5 minutes. After the time period, the timer 103 can open a transistor of the taper-off circuit 108 to connect or activate the taper-off circuit. At that time, a capacitor, such as the capacitor 112 of the taper-off circuit 108 begins to charge. As the capacitor 112 charges, the current through the field winding or coil decreases to gradually taper of the motor until it stops. The circuit 100, and particularly the timer 103 and taper-off circuit 108 can be particularly tailored to produce specific motor slow down characteristics, as desired.

Another advantage produced by the disclosed mattress with internal vibrator is that the mattress is highly suitable for children. The vibrating device 12 as disclosed herein is water resistant and will not be damaged when fluids come in contact with the device. It is known that infants and young children are prone to bed wetting. It is also known that the sleeping patterns of infants and young children are positively affected by use of vibrating mattresses. The disclosed vibrating mattress is especially well suited for use with infants and children because it will not be damaged when the mattress becomes wet. The combination of the waterproof vibrating device 12 and the gradual slow down feature renders the disclosed mattress with internal vibrator especially well suited for children.

A further advantage produced by the disclosed mattress with internal vibrator is that the vibrator, though internally mounted, can be easily removed from the mattress for service, repair, or replacement. Further, the device permits access to the power source 81 such as the batteries 102 without removing the device. The batteries or power source can be easily serviced or replaced. For repair or replacement, the motor housing 40 slips into and out of the sleeve 30 easily and results in no damage to the mattress. In one example, only a single screw need be removed to release the motor housing from the sleeve.

Further, since the device 12 is self-contained and has its own internal power source, it need not be plugged into a regular wall outlet. As a result, the mattress 10 can be utilized virtually anywhere without the need for accessing an external power source.

Although certain methods and mattress examples have been disclosed and described herein in accordance with the teachings of the present invention, the scope of coverage of this patent is not limited thereto. On the contrary, this patent covers all embodiments of the teachings of the invention fairly falling within the scope of the appended claims, either literally or under the doctrine of equivalents.

What is claimed is:

1. A mattress comprising:

an internal support structure;

an external cladding that surrounds and covers at least a portion of the support structure;

a mattress vibrating device coupled to a part of the support structure, the vibrating device having a motor that when operating vibrates the part of the support structure and that gradually slows at a controlled rate to a complete stop over a period of time when operation is complete; and a sleeve mounted within the mattress and coupled to the support structure, the motor being removably housed within the sleeve and its vibrations transmitted through the sleeve to the support structure.

2. A mattress according to claim 1, wherein the motor can be selectively operated at one of at least two different vibration levels.

3. A mattress according to claim 1, wherein the motor gradually slows to a stop at the controlled rate over the predetermined period of time from each of the at least two different vibration levels when operation of the vibrating device is complete.

4. A mattress according to claim 1, wherein the period of time over which the motor gradually slows to the complete stop is at least about 10 seconds.

5. A mattress according to claim 1, wherein the controlled rate at which the motor gradually slows is a linear, continuous deceleration rate.

6. A mattress according to claim 1, wherein the controlled rate at which the motor gradually slows is a stepped down deceleration rate.

7. A method of operating a vibrating mattress having a vibrating device with a motor, the method comprising the steps of:

mounting a sleeve within the mattress;

coupling the sleeve to a mattress support structure;

removably sliding the motor into the sleeve such that motor vibrations are transmitted through the sleeve to the support structure;

operating the vibrating device to vibrate the mattress; and adapting a part of the vibrating device such that vibration of the vibrating device gradually slows to a stop at a controlled rate over a predetermined period of time when the step of operating is complete.

8. A method according to claim 7, wherein the period of time over which the vibrating device gradually slows to the complete stop is at least about 10 seconds.

9. A method according to claim 7, wherein the step of operating further comprises:

selectively operating the motor at one of at least two different vibration levels, and wherein the vibrating device gradually slows to a stop at the controlled rate over the predetermined period of time from each of the at least two different vibration levels when the step of operating is complete.

10. A vibrating mattress comprising:

a support structure;

a mattress cladding that surrounds and covers at least a portion of the support structure; and a vibrating device including a plurality of components, a motor housing substantially encompassing the plurality of components, and a sleeve mounted internal to part of the mattress and coupled with an element of the support structure, the motor housing removably received within the sleeve and arranged to transmit vibrations through the sleeve for vibrating the mattress, the sleeve being water resistant.

11. A mattress according to claim 10, further comprising:

a pocket provided within the mattress, the pocket having an opening that exposes a pocket interior to a mattress exterior, the pocket interior being adapted to receive the sleeve therein through the opening.

12. A mattress according to claim 10, wherein the plurality of components includes at least a motor, a vibrating element selectively driven by the motor, and a battery providing power to operate the motor.

13. A mattress according to claim 10, wherein the sleeve contacts a transmission plate that is in contact with the support structure.

14. A mattress according to claim 13, wherein the sleeve substantially surrounds and contacts the motor housing of the vibrating device and is in contact with the transmission plate.

15. A mattress comprising:

a support structure;

a mattress cladding that surrounds and covers at least a portion of the support structure;

a self contained vibrating device having an exterior housing and a part of the vibrating device coupled with part of the support structure for vibrating the mattress, the vibrating device when operating vibrates the part of the support structure and gradually slows at a controlled rate to a complete stop over a period of time when operation is complete; and a sleeve having a sleeve interior, the sleeve being mounted within a portion of the mattress and the self contained vibrating device being slidably received within and slidably removable from the sleeve interior.

16. A mattress according to claim 15, further comprising:

a pocket mounted within the mattress, wherein the sleeve is received in the pocket and a portion of the vibrating device couples with the support structure.

17. A mattress according to claim 15, further comprising:

a pocket mounted within the mattress, wherein the sleeve and the self contained vibrating device are slidably received within the pocket.

18. A mattress according to claim 15, further comprising:

a transmission plate in contact with the support structure and with the sleeve.

* * * * *